US005320019A

United States Patent [19]

McCaw

[11] Patent Number: 5,320,019

[45] Date of Patent: Jun. 14, 1994

[54] HAMMER MECHANISM FOR HAND-HELD, STRINGED MUSICAL INSTRUMENT

[76] Inventor: Kenneth J. McCaw, 57 Sheffield Rd., Columbus, Ohio 43214

[21] Appl. No.: 995,327

[22] Filed: Dec. 23, 1992

Related U.S. Application Data

[63] Continuation of Ser. No. 678,013, Apr. 1, 1991, abandoned.

[51] Int. Cl.[5] ..... G10D 3/16

[52] U.S. Cl. ..... 84/323

[58] Field of Search ..... 84/323, 324, 320, 453, 84/12, 8, 9, 465, 422.4

[56] References Cited

U.S. PATENT DOCUMENTS

| | | | |
|---|---|---|---|
| 1,176,458 | 3/1916 | Jost | 84/324 |
| 1,223,072 | 4/1917 | Jost | 84/324 |
| 1,310,024 | 7/1919 | Krawczyk | 84/324 |
| 2,006,998 | 7/1935 | Marzullo | 84/320 |
| 2,586,163 | 2/1952 | Heiderich et al. | 84/422.4 |
| 3,293,975 | 12/1966 | Koniecki | 84/320 |
| 3,797,357 | 3/1974 | Thomas et al. | 84/423 R |
| 4,037,503 | 7/1977 | Jacobson et al. | 84/9 |

*Primary Examiner*—Michael L. Gellner
*Assistant Examiner*—Cassandra C. Spyrou
*Attorney, Agent, or Firm*—Frank H. Foster

[57] ABSTRACT

An attachable accessory for a hand-held, stringed musical instrument, such as a guitar, the invention comprises a hammer arm with a hammer head at one end which pivots at the opposite end. Actuating rods, which are struck by the fingers, press the hammer arm downward causing the hammer head to strike the strings of the instrument. The apparatus is clamped to the bridge pins of the guitar or are otherwise removably attachable to the instrument. The instrument is playable in the conventional manner with the apparatus attached. A bias means returns the hammer arm to its initial position after displacement by the actuating rod.

2 Claims, 3 Drawing Sheets

HAMMER MECHANISM FOR HAND-HELD, STRINGED MUSICAL INSTRUMENT

This is a continuation of application No. 07/678,013, filed Apr. 1, 1991, now abandoned.

TECHNICAL FIELD

The present invention relates to an attachment accessory which is removably fastened to a hand-held, stringed musical instrument and is used for striking the strings of the instrument.

BACKGROUND ART

Stringed musical instruments have strings which are vibrated to produce sound. Conventional methods for causing the strings to vibrate include both striking and plucking of the strings. Each of these two methods has advantages and disadvantages. Plucking, including strumming, involves forcing the string in one direction and then quickly releasing it and allowing it to vibrate freely. Plucking of a single string is accomplished very easily with the fingers, but plucking several strings at once or a few strings among many is quite difficult and requires quickness and dexterity of the fingers. In addition, some chords or patterns of notes are extremely difficult or altogether impossible to play with the plucking method.

Striking of the strings is normally accomplished by a complex series of linkages, levers and hammers which is activated by pressing a key with a finger. The linkage apparatus is typically quite large making the instrument either large and heavy or small, intricate and very expensive due to high manufacturing costs. The large apparatus also makes it very difficult to play the instrument the conventional way while the striking apparatus is in place. A striking apparatus, however, may enable even an intermediate musician to play virtually any pattern of notes and produce a sound quality different than that produced by plucking.

Hand-held, stringed instruments are usually played by plucking the strings either with the fingers, or with a pick. The method of plucking the strings is used since attaching a conventional, piano-type, multi-link lever and striker apparatus would prove impractical on a hand-held instrument. However, the advantages which striking mechanisms have over conventional plucking are significant, especially if a striking apparatus can be used in conjunction with, and does not prevent the use of the conventional finger plucking method.

In U.S. Pat. No. 1,137,562, Winlund discloses a linkage apparatus for a dulcimer which is mounted above the strings of the instrument and is activated by keys. Winlund's complex apparatus contains at least three levers having two fulcrums for each string of the instrument. This apparatus comprises a series of linkages that, when struck with a finger, strike the string of the dulcimer. While this mechanism appears to accomplish its string striking goal, the complexities of the linkages and the sheer size of the entire apparatus would prohibit the simple and economical use of this on a conventional hand-held instrument, especially if conventional plucking or strumming are also desired.

In U.S. Pat. No. 726,084, Menze discloses a cithern mounted string striking apparatus which is also operated through a plurality of levers and fulcrums by striking a key. The Menze key striking apparatus is, in the main embodiment, attached to the cithern at one end requiring that the cithern be played in an abnormal vertical position. This apparatus has an additional requirement that one play it in a vertical, upright position and then move it to the conventional horizontal position to play it in the conventional manner. Additionally, the linkages involved in Menze's apparatus are quite complex decreasing the reliability of it and requiring the apparatus to be either large and heavy or prohibitively expensive. The attachment of the apparatus to the cithern does not appear to facilitate easy attachment and removal since it covers one end entirely.

In U.S. Pat. No. 2,380,689, Goodwin discloses a string striking apparatus which is actuated by a foot actuator which causes bent wire arms to strike the strings. The Goodwin string striking apparatus is gear driven so that certain strings are struck with each foot actuated rotation of the gear. The pattern of notes which is to be played is pre-selected prior to actuation of the arms by the foot lever and therefore one can not freely play the stringed instrument as is most often desired. It additionally appears as though it would be difficult to play the stringed instrument in the conventional manner with this apparatus attached. This apparatus also appears to be complex in its gearing and linkages, increasing the likelihood of malfunctions.

It is desirable to have an apparatus that can be removably attached to a hand-held, stringed musical instrument, such as a guitar, to facilitate striking of the strings and access to additional sound qualities inherent in striking of strings. It is also desirable that the apparatus offer the player new note pattern playing ability while allowing conventional strumming or picking of the guitar with negligeable interference from the apparatus. It is additionally desirable that the apparatus be simple in construction to decrease the possibility of it malfunctioning, and allowing it to be inexpensive and therefore accessible to the intermediate, amateur musician.

Therefore there is a need for a removably fastenable, simple and unobtrusive means for striking the strings of a hand-held, stringed musical instrument.

BRIEF DISCLOSURE OF INVENTION

This invention relates to an improved string striking apparatus for attachment to a hand-held, stringed musical instrument. The improved string striking apparatus comprises a support frame and a hammer. The hammer comprises a hammer arm mounted to the support frame, and a hammer head which is mounted near one end of the hammer arm. The string striking apparatus further comprises an actuating key which engages the hammer arm transversely. The string striking apparatus further comprises a bias means which is mounted to the support frame and which urges the hammer away from the string.

Figure 1:
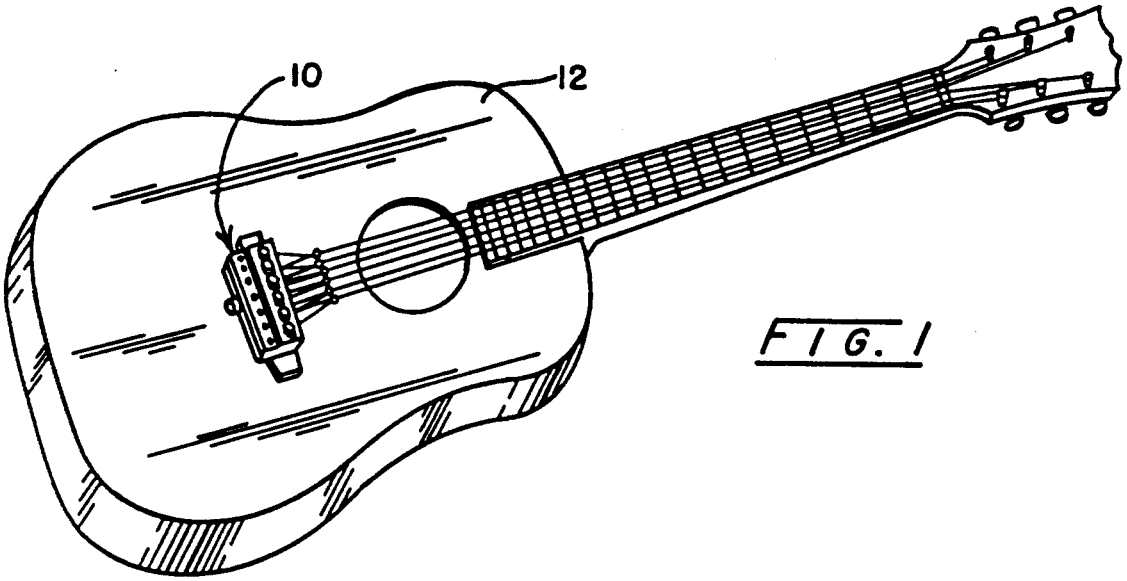
FIG. 1 is a view in perspective illustrating the preferred location of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Figure 2:
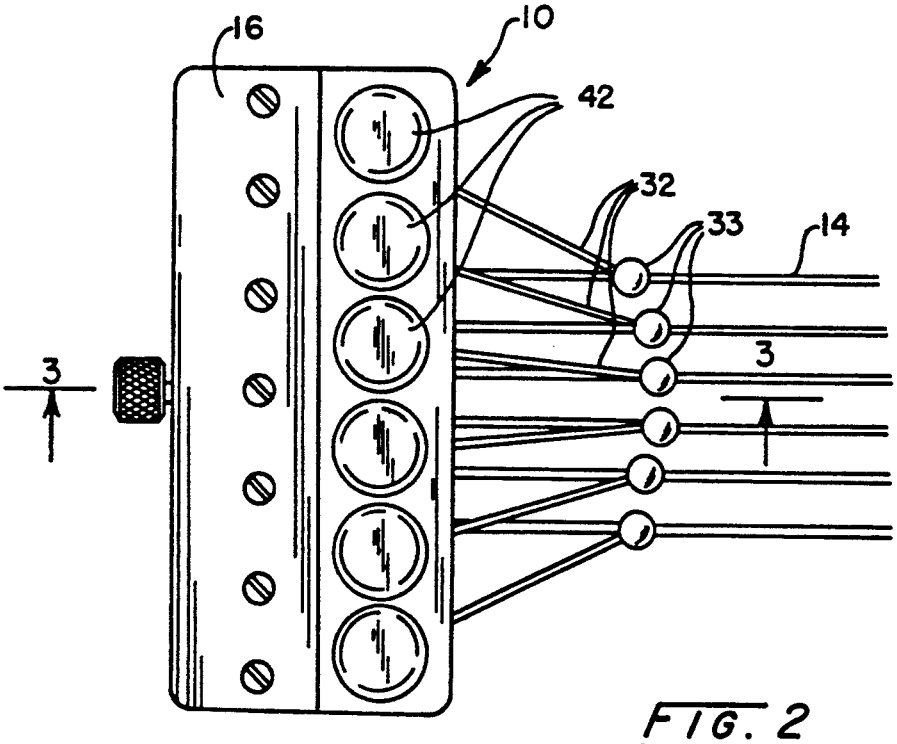
FIG. 2 is a top view illustrating a more detailed perspective of the preferred location of the present invention.

FIG. 1 shows the preferred location of striking means 10 on a guitar 12, which is one of the many handheld, stringed instruments on which the present invention can be used. The striking means 10 is preferably mounted to the bridge pins of the guitar 12, described below. FIG. 2 is a top view illustrating the striking means 10 shown in FIG. 1 and showing the orientation of the striking means 10 relative to strings 14 of the guitar 12.

Figure 3:
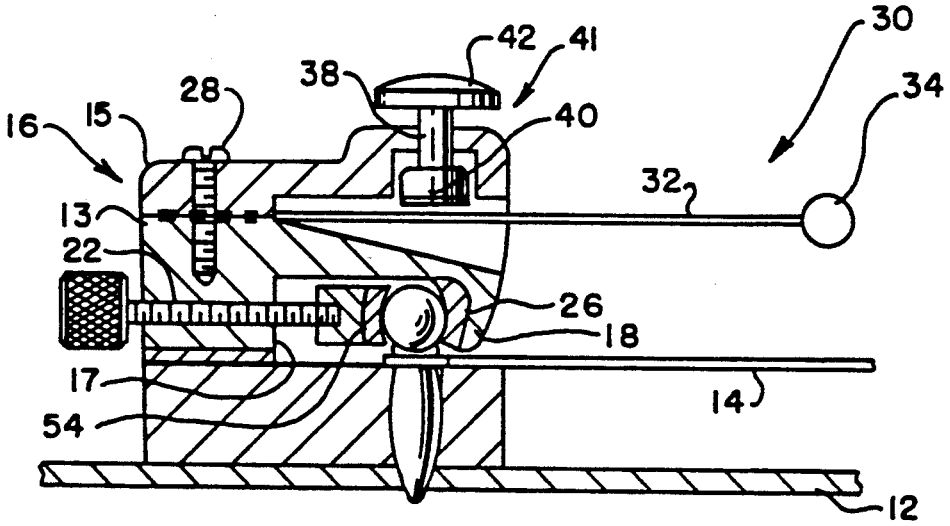
FIG. 3 is a side view in section of FIG. 2 along the axis 3—3.

FIG. 3 is a side view in section along the axis 3—3 of the striking means 10 of FIG. 2. The striking means 10 comprises a frame 16 which is preferably made of a molded plastic material. The frame 16 preferably includes two sections 13 and 15 which are held together by a plurality of screws 28 extending through the top section 15 and seating into the bottom section 13 to tighten the two sections 13 and 15 together.

The frame 16 attaches to the guitar 12 by clamping onto bridge pins 20 of the guitar 12. The bottom section 13 of the frame 16 has a channel formed in its underside, having walls 17 and 18 defining opposite sides of the channel. A clamping screw 22 is threaded through the wall 17 and extends into the channel. At the end of the clamping screw 22, there is a clamping pad 24 which is a concave surface that is shaped to matingly engage the bridge pins 20. On the wall 18 another clamping pad 26 is mounted which is similarly shaped to the clamping pad 24 and which also matingly engages the bridge pins 20. Upon tightening of the clamping screw 22, the clamping pad 24 forces the bridge pins 20 against the clamping pad 26, holding the frame 16 in place.

A hammer 30, comprises a hammer arm 32 and a hammer head 34. The hammer arm 32 is a flexible, resilient material, preferably spring steel or a suitable plastic, which is co-planar with five other hammer arms in the preferred embodiment. The plane of the hammer arms 32 is parallel to the plane of the strings 14 of the guitar 12. The hammer arms 32 extend laterally from between the sections 13 and 15 of the frame 16 where the hammer arms 32 are clamped in place by tightening the sections 13 and 15 together. The hammer head 34 is either mounted to, or formed as an integral part of, the hammer arm 32 and is located near the end of the hammer arm 32 opposite the frame 16 in the preferred embodiment.

The preferred hammer arm has a rectangular cross-section with the long sides parallel to the plane of the strings of the guitar. This prevents the hammer arms from moving laterally along the plane of the strings causing the hammer heads to possibly miss the string which they are assigned to strike.

It is possible to attach the hammer arms together at the ends which are clamped between the upper and lower sections of the frame. The hammer arms could all be attached to a backbone, forming a structure similar to a comb, which has teeth extending from a backbone. The backbone of the invention could then be clamped in the frame with the hammer arms extending from between the upper and lower sections of the frame.

In the preferred embodiment, an actuating key 41, including an actuating rod 38, extends through a hole formed in the upper section 15 of the frame 16 above the hammer arm 32. The axis of the actuating rod 38 is approximately perpendicular to the hammer arm 32. At the end of the actuating key 41 which is nearest the hammer arm 32, a striking pad 40 is formed which is larger in diameter than the hole in the upper section 15 of the frame 16 through which the actuating rod 38 extends. The striking pad 40 prevents the actuating rod 38 from sliding upwards and out of the hole in the frame 16.

At the end of the actuating key 41 opposite the striking pad 40 a key pad 42 is mounted. The key pad 42 is preferably a dome shaped disc, mounted coaxially with the actuating rod 38. The top of the key pad 42 is the surface which the finger will engage to operate the striking means. The key pad 42 also prevents the actuating rod 38 from extending too far through the hole formed in the upper section 15 of the frame 16.

Referring to FIG. 2, a plurality of such key pads 42 is located above the frame 16 and an equal number of cooperating hammers 32, actuating rods and strings 14 are below in their respective locations. Each individual hammer arm 32 is angled inward toward the string 14 above which its hammer head 33 is located.

There are preferably six key pads 42, six actuating rods 38, six striking pads 40, and six hammers 30 for the six guitar strings 14. A greater or lesser number of these elements may be used to suit the number of strings of the musical instrument. For example, a bass guitar would have four strings and therefore, four key pads and four hammers.

The operation of the apparatus 10 is as follows. Referring to FIG. 3, the key pad 42 is struck by the finger of the guitar player. This forces the entire actuating key 41 downward in FIG. 3 toward the hammer arm 32, with the striking pad 40 contacting the hammer arm 32 transversely, displacing the hammer 30 along an arcuate path toward the string 14.

In the preferred embodiment, the key pad 42 or a suitable shoulder formed on the actuating rod 38 seats against the top surface of the frame 16 before the hammer head 34 strikes the string 14. When the key pad 42 or shoulder seats against the frame 16, therefore halting the motion of the actuating key 41, the hammer arm 32 separates from the striking pad 40 and the momentum of the hammer 30 carries it away from contact with the striking pad 40 and into contact with the string 14. Upon striking the string 14, the hammer 30 springs back toward the striking pad 40 and, after some displacement of the hammer 30, returns into contact with the striking pad 40.

This excursion of the hammer 30 beyond the striking pad 40 prevents the player from pressing the hammer head 34 against the string 14 and holding it there. Holding the hammer head 34 against the string 14 is undesirable and without halting the motion of the actuating key 41, can only be avoided by "bouncing" the finger quickly against the key pad 42 and releasing it. This can be done with practice and an embodiment not having the halting of the actuating key 41 is desired as an alternative embodiment.

After the hammer 30 returns into contact with the striking pad 40, the hammer 30 is ready to be driven toward the string 14 again by striking the key pad 42, or, under the bias of the flexed hammer arm 32, it returns to its original position, co-planar with the other hammers 30.

Figure 4:
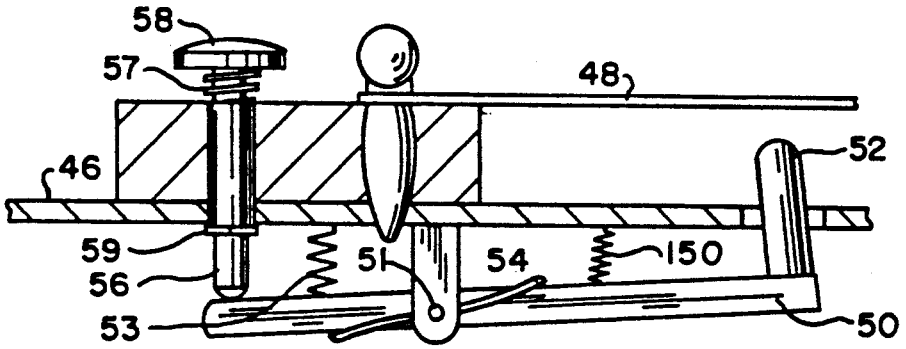
FIG. 4 is a side view in section illustrating an alternative embodiment of the present invention.

While the preferred location of the present invention is removably fastened to the outside of the instrument, it is possible to more permanently attach the present invention, or at least a portion of it, to the interior of the instrument. FIG. 4 is a side view in section illustrating a guitar 46 and strings 48. A hammer head 52 is attached to a hammer arm 50 which pivots about a pin 51 which extends perpendicularly through the hammer arm 50 and through the fulcrum arm 54 which is attached to the interior of the guitar 46. An actuating rod 56 extends through a hole in the guitar 46 into the interior of the guitar 46 and contacts the hammer arm 50 at the end opposite the hammer head 52. A key pad 58 is attached outside the guitar 46 to the end of the actuating rod 56 opposite the end which contacts the hammer arm 50. A spring 57 is coiled around the actuating rod 56 and seats against the outer surface of the guitar 46 and the key pad 58. The spring 57 biases the actuating rod 56 away from the interior of the guitar. A shoulder 59 is formed on the actuating rod 56 at the end inside of the guitar. The diameter of the shoulder 59 is greater than that of the hole and the shoulder 59 prevents the actuating rod 56 from sliding out of the hole.

It is possible to attach a spring 55 to the hammer arm 50 as shown in FIG. 4. This torsion spring biases the hammer arm 50 away from the string 48. Coil springs 53 and 150 may be attached between the hammer arm 50 and the guitar 46 to bias the hammer arm 50 away from the string 48. Not all three springs 53, 55 and 150 need to be simultaneously in place to bias the hammer arm 50.

When a finger strikes the key pad 58, the actuating rod 56 is displaced toward the hammer arm 50, displacing one end of the hammer arm 50 and, by pivoting of the hammer arm 50 about the pin 51 through the fulcrum arm 54, the opposite end of the hammer arm 50 extends toward the string 48. The hammer head 52 follows an arcuate path through the hole in the guitar 46 and strikes the string 48 as previously described for the preferred embodiment.

Figure 5:
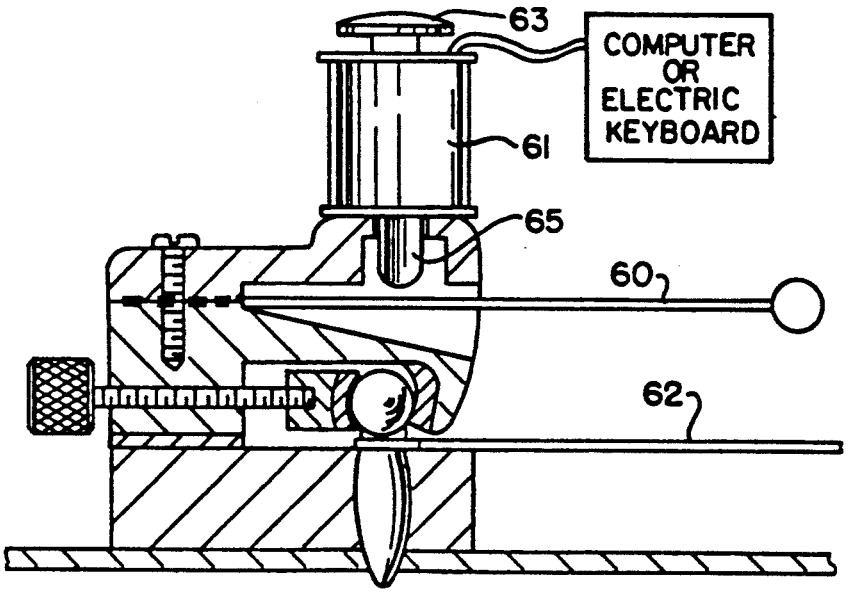
FIG. 5 is a side view in section illustrating an alternative embodiment of the present invention.

Another alternative embodiment is illustrated in FIG. 5 which shows a solenoid 61 which strikes a hammer arm 60 forcing it downward to strike a string 62. In this embodiment, an actuating key 65 of the solenoid 61 is actuated by a key pad 63, located at the upper end of the actuating key 65, which is struck by a finger making the subsequent striking of the string power assisted. Alternatively, the solenoid 61 may be computer actuated or linked to an electric keyboard instead of the key pad 63.

Figure 6:
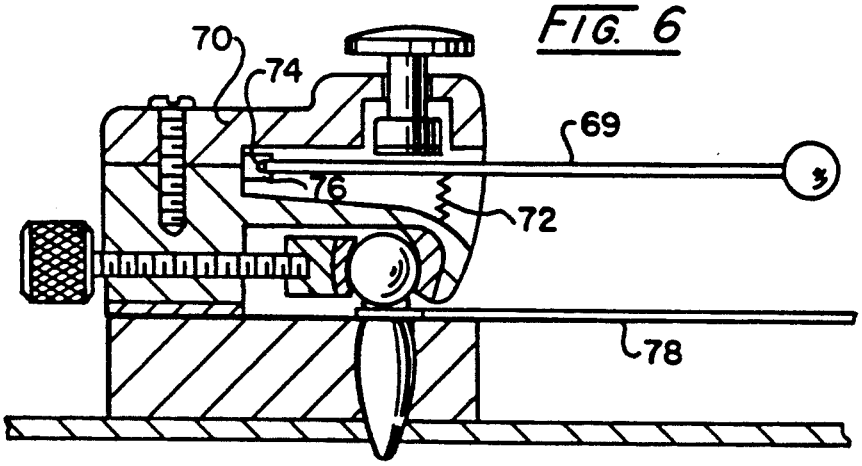
FIG. 6 is a side view in section illustrating an alternative embodiment of the present invention.

FIG. 6 is a side view in section of an alternative embodiment of the present invention. The embodiment of FIG. 6 differs only slightly from the preferred embodiment in the pivotal attachment of a hammer arm 69 to a frame 70. Additionally, the bias of the embodiment in FIG. 6 is a coil spring 72. The hammer arm 69 attaches hingedly to the frame 70 by a link 74 which has a hole through it and through which a pin 76 passes which also passes through a hole in the hammer arm 69. The hammer arm 69 pivots about this hinge pin 76 and is biased away from guitar string 78 by the coil spring 72. The coil spring 72 attaches generally perpendicular to the hammer arm 69 and extends downward and attaches to the frame 70. The spring 72 is therefore compressed during actuation of the hammer arm 69 and returns the hammer arm 69 to its original position after operation.

With the present invention in its preferred location, the guitar, or the other hand-held, stringed musical instrument to which the present invention is fitted, can be played either with the striking means or in the conventional plucking or strumming manner.

While the preferred hammer is a hammer arm having an enlarged spherical head, the hammer head could comprise merely the blunt end of the hammer arm. The end of the hammer arm could merely be rounded over or formed in some other suitable string-engageable shape. Additionally, the head could be made of a different material than that of the hammer arm. For example, if the hammer arm is a spring steel wire, then the head could merely be a round wooden sphere with a hole through it, such as a bead.

Figure 7:
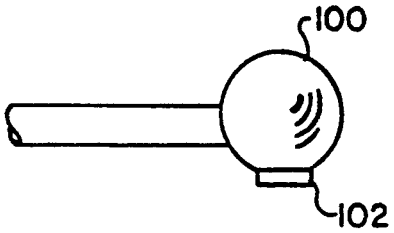
FIG. 7 is a side view illustrating an alternative hammer head embodiment.

The hammer head could also be made to rotate about the hammer arm and have different string striking surfaces which, upon rotation, that surface would strike the string and cause a new and different sound than the previous surface. An example of this is shown in FIG. 7. This embodiment of the new head shows a hammer head 100 which has a piece of soft material 102, such as felt, glued to one side. The soft material 102 would provide a different sound than the rest of the hammer head 100. These two surfaces additionally allow the life of the hammer head to be extended by merely rotating to the next new surface.

In a further hammer head embodiment, the surface of the hammer head which contacts the string may be shaped to be concave. In this embodiment, the hammer head ideally strikes the string in the deepest portion of the cavity of the head, to prevent the hammer head from shifting laterally when it contacts the string.

Figure 9:
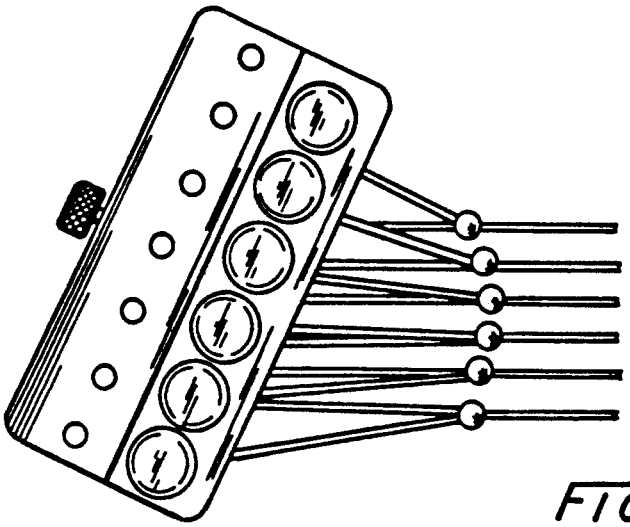
FIG. 9 is a top view illustrating an alternative angle of the row of key pads relative to the strings.

The key pads 42 in FIG. 2 are oriented in a line which is generally perpendicular to the strings 14. It is possible to align the key pads 42 on the frame 16 in a line or an arc which matches different positions of the fingers as is shown in FIG. 9. This line or arc may be angled relative to the strings 14 allowing the guitar player's forearm to extend over the top of the guitar rather than across the end of the guitar. This alignment of the key pads 42 would more easily facilitate the use of the present invention on a plurality of hand-held, stringed musical instruments, for example a bass guitar which is usually played by extending the forearm over the top of the guitar, generally perpendicular to the strings.

Figure 8:
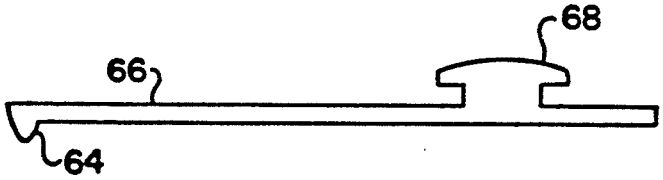
FIG. 8 is a side view illustrating an alternative hammer.

FIG. 8 illustrates a side view of an alternative hammer arm 66 to which a finger engageable key 68 is mounted or formed as an integral part. This embodiment eliminates the need for a sliding actuating rod mounted within the frame, but would additionally require that the player bounce the keys and the hammer against the strings to prevent applying hammer head 64 against the strings for an extended period of time. The preferred embodiment has a shoulder against which the key seats preventing the hammer head from "laying" against the strings, but the embodiment of FIG. 8 has no such preventative means.

While certain preferred embodiments of the present invention have been disclosed in detail, it is to be understood that various modifications may be adopted without departing from the spirit of the invention or scope of the following claims.

I claim:

1. An improved guitar having a guitar body to which a plurality of generally parallel strings are mounted, wherein the improvement is a manually actuated string playing apparatus, the improvement comprising:

(a) a support frame removably mounted to the guitar body;

(b) a plurality of hammers attached to the support frame, each of said hammers comprising a resilient hammer arm fixed at one end to the support frame and a hammer head fixed at a second end and spaced from a string; and (c) a plurality of actuating keys each of said keys being rigidly fixed as an integral part to one of said hammer arms between said hammer arm ends to form a one piece composite key and hammer.

2. An improved guitar in accordance with claim 1 wherein the actuating keys are aligned in a row which is oriented transversely to the strings.

* * * * *